US006668703B2

(12) United States Patent
Gamble

(10) Patent No.: US 6,668,703 B2
(45) Date of Patent: Dec. 30, 2003

(54) PISTON WITH OIL TRAP

(76) Inventor: Christopher Gamble, 19428 Business Center Dr., Unit A, Canoga Park, CA (US) 91324

( * ) Notice: Subject to any disclaimer, the term of this patent is extended or adjusted under 35 U.S.C. 154(b) by 55 days.

(21) Appl. No.: 09/970,411

(22) Filed: Oct. 2, 2001

(65) Prior Publication Data

US 2002/0046648 A1 Apr. 25, 2002

Related U.S. Application Data

(60) Provisional application No. 60/237,947, filed on Oct. 3, 2000.

(51) Int. Cl.[7] ..... F01B 31/08
(52) U.S. Cl. ..... 92/186
(58) Field of Search ..... 92/186; 277/465

(56) References Cited

U.S. PATENT DOCUMENTS 2,179,670 A * 11/1939 Richards ..... 277/465
3,336,844 A * 8/1967 Cornet ..... 92/186
4,011,797 A * 3/1977 Cornet ..... 92/186

* cited by examiner

*Primary Examiner*—F. Daniel Lopez
(74) *Attorney, Agent, or Firm*—Gregory J. Nelson

(57) ABSTRACT

A piston for a combustion engine having an oil ring groove on the exterior of the piston which communicates via oil holes with an oil trap extending around the interior of the piston. The oil trap captures lubricant on the downward stroke and pumps lubricant to the piston and cylinder walls on the upward stroke. An oil ring assembly having a wiper, expander and oil ring sections may be provided in the oil ring groove. A bridge may also be provided to support the cylinder head.

9 Claims, 4 Drawing Sheets

PISTON WITH OIL TRAP

This application is based on provisional application Ser. No. 60/237,947, filed Oct. 3, 2000, titled "Piston With Oil Trap."

FIELD OF THE INVENTION

The present invention relates to combustion engines and more particularly relates to an improved piston and ring design for combustion engine which piston may be used in connection with both gas and diesel fueled engines.

BACKGROUND OF THE INVENTION

Basically, a piston for a combustion engine consists of a generally cylindrical body enclosed at the top by a piston head connected to the crankshaft of an engine by a connecting rod. Power is generated as the fuel/air mixture combusts causing the piston to reciprocate. A transversely extending boss within the cylinder body defines a journal which receives the wrist pin connected to the connecting rod. Annular grooves separated by lands to piston heads receive rings. Two types of rings are received in the grooves: (1) compression rings; and (2) oil rings. Compression rings prevent combustion gases from leaking past the piston into the crank case below the piston. The compression rings also wipe some of the oil from the cylinder wall when the piston is on the downward stroke. Compression pressure behind the compression rings force the compression rings against the cylinder wall.

Good lubrication requires an oil film to be distributed between the piston and cylinder wall. The purpose of oil rings is to control the distribution of oil and prevent the oil from escaping to the combustion chamber. The conventional oil ring defines a plurality of small holes or slots spaced around the groove. The oil control ring scrapes oil from the cylinder and directs it through these holes. There are variations to this conventional design which can be found in the prior art. Representative piston designs are as follows:

The early patent to King, et al, U.S. Pat. No. 1,519,918, shows a piston having annular ring receiving grooves which are downwardly and outwardly beveled to enhance lubrication.

U.S. Pat. No. 2,560,253, shows a piston having an oil ring which is spring-loaded.

Corrugations and notches in the spring and slots provide passageways through which oil scraped from the cylinder walls by the ring may flow to the interior of the piston.

In U.S. Pat. No. 2,860,614, a piston is shown in which lubricant escapes from the underside of the piston and passes through passages in the skirt. A channel may be provided at the base of the cylinder to collect lubricant as it runs down the cylinder walls and as it leaves the passages in the skirt.

In U.S. Pat. No. 2,187,724, shows a piston and ring assembly having oil ring grooves spaced downwardly from the compression ring grooves and a gas pressure groove between the compression grooves and the oil ring groove. The gas-pressured groove receives the gases that manage to blow by the compression rings.

In U.S. Pat. No. 2,857,218, shows a piston having two oil scraper rings that are inserted in the proximity of the lower end of the piston.

In U.S. Pat. No. 4,462,601, shows a piston having a duct provided between the high pressure of the seal and the bottom of the piston ring groove. The resistence against gas flow between the high pressure side and the piston ring along the piston and cylinder walls is greater. Thus, the piston ring will be forced into a sealing position when the engine is pressurized.

In U.S. Pat. No. 4,836,093, shows a piston having at least one aperture in at least one compression ring groove. The aperture is in fluid communication with the interior of the hollow skirt portion of the piston communicating lubricant gathered in the compression ring groove into the interior of the hollow skirt so that the lubricant can return to the crank case.

Thus, from the foregoing, it can be seen that the various arrangements for removing, collecting and redistributing the lubricant or oil film occurring on the cylinder walls. However, many of these arrangements are expensive, difficult to manufacture requiring extensive machining operations, or are ineffective to achieve enhanced lubrication.

BRIEF SUMMARY OF THE INVENTION

Briefly, the present invention provides an improved piston for a combustion engine. The piston has an oil trap feature which improves lubrication and cooling. The piston is generally cylindrical having a body having a head and a depending skirt. The piston head may be integrally formed as part of the body or may be inserted in top of the piston head and maintained by a press fit. The inside of the head is shaped to force lubricating oil to interior oil traps formed within the piston head. The exterior of the piston defines one or more annular grooves, which receive a compression ring. At least one oil ring extends annularly about the exterior of the piston. An oil trap extends within the interior cavity of the piston head located interiorly of the oil rings. The oil trap has a bottom surface which extends about the interior wall of the piston and which extends upwardly forming an acute angle with the interior piston wall. A plurality of holes extend through the piston wall communicating with the oil trap. The oil trap captures lubricant on the downward stroke of the piston in the cylinder and delivers the lubricant through the holes on the upward stroke. This pumping of fluid on the upward stroke will also provide a cooling effect as the oil moving between the piston and cylinder will absorb heat and scrape or wipe dirt off the cylinder walls and piston keeping the surfaces clean.

In a further aspect of the present invention, an improved oil ring assembly is received in the annular oil grooves. The oil ring assembly includes an upper oil ring which will wipe oil off the cylinder walls as the piston reciprocates. An expander ring is interposed between the upper oil ring and the lower oil ring. The expander ring has a generally wave-like configuration with holes extending through the ring. The lower ring is generally flat having a plurality of notches or grooves extending around the periphery of the lower ring. The small notches allow the oil to move downwardly as the piston moves upwardly. The oil ring assembly can be integrally formed or can be separate components inserted and assembled within the oil grooves.

In addition, the piston assembly includes a bridge member extending between the interior bosses which define the journal bearing surfaces which receive the wrist pin at the upper end of the piston rod. The bridge member extends upwardly to provide a support for the piston head engaging the interior or underside of the piston head.

The present invention also provides a single ring assembly which includes at least one compression ring and an oil trap and pumping feature.

BRIEF DESCRIPTION OF THE DRAWINGS

The above and other objects and advantages of the present will be more fully understood and appreciated from the following description, claims and drawings in which:

DETAILED DESCRIPTION OF THE DRAWINGS

Figure 1:
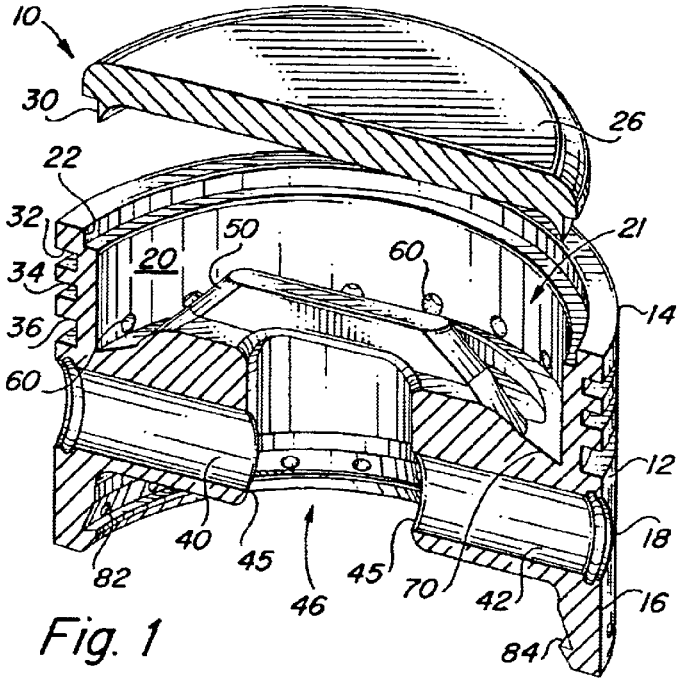
FIG. 1 is a perspective cut-away view showing a piston according to the present invention.
Figure 2:
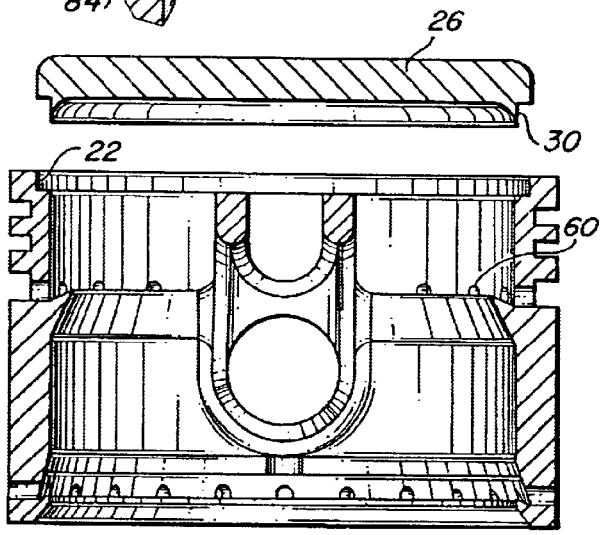
FIGS. 2 and 2A are cross-sectional views showing a piston of the present invention with the piston head shown assembled in FIG. 2A and exploded view in FIG. 2.
Figure 2A:
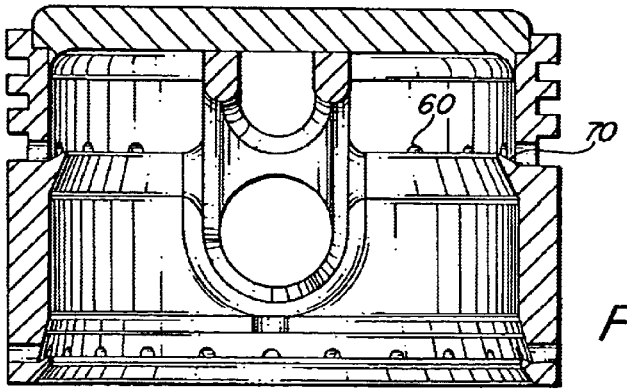
Figure 3:
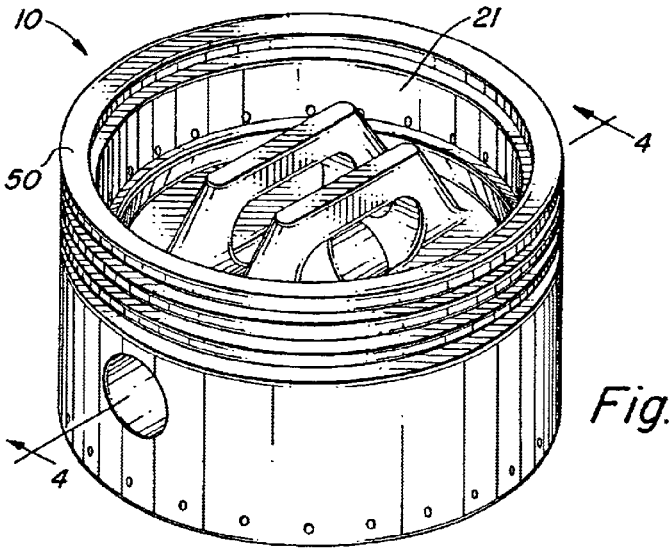
FIG. 3 is a perspective view of the piston with the head removed illustrating the interior support bridge provided for the piston head.
Figure 4:
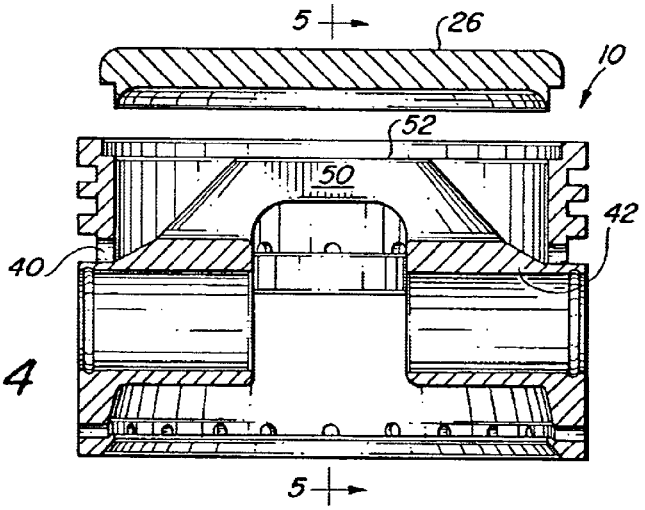
FIG. 4 is a cross-sectional view taken along line 4—4 of FIG. 3.
Figure 5:
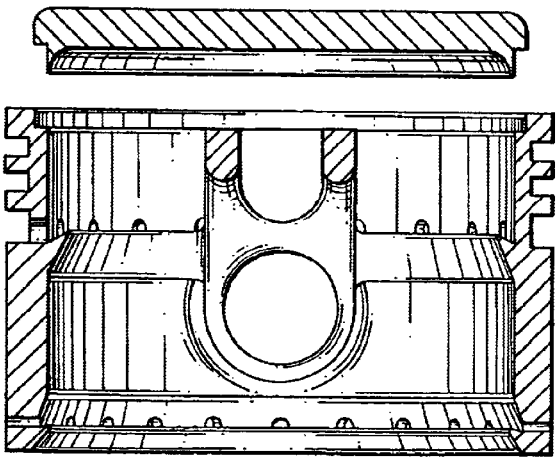
FIG. 5 is a cross-sectional view taken along line 5—5 of FIG. 4.

Turning now to the drawings, particularly FIGS. 1, 2 and 2A, the piston of the present invention is generally designated by the numeral 10. It is to be understood that the piston 10 can be provided in various sizes and is adaptable for use both in combustion engines and diesel engines. Similarly, the material may be any conventional material such as steel or various alloys used for pistons. Further, the pistons may be provided with coatings of various types to reduce friction and to enhance heat transfer.

The piston 10 includes a generally cylindrical body 12 having an upper end 14 and a lower skirt portion 16. The piston body has a cylindrical outer wall or surface 18 and an inner wall or surface 20. The upper end of the piston 14 defines an undercut 22 which receives the piston head 26 which defines an interior cavity 21. The piston head 26 is generally circular and having a depending lip 30 which is received in the undercut groove of the upper portion of the piston body. The head may be secured to the body by any conventional means such as by a shrink or press fit, or the piston may be cast or machined as a single unit. The piston head and the body may be formed as separate components because of the difficulties encountered in manufacturing the piston as a single piece.

The piston body defines a first or upper annular groove 32 extending in the area below the head. The upper groove 32 receives an upper compression ring, not shown, as is conventional. Generally piston rings are made of cast iron or other material such as stainless steel and may be faced or plated with chrome steel or the like. Combustion pressure enters the groove behind the compression ring and forces it outwardly against the cylinder wall. There are various types of piston rings such as tapered, planed, grooved counter board and the like. Any of these various types of compression rings may be used in the upper compression ring groove 32.

Beneath the upper compression ring groove is a second or lower compression ring groove 34. Compression ring groove 34 is also annular and is configured to receive a compression ring as described above to seal and to wipe the surface of the cylinder as the piston reciprocates. The compression rings serve to prevent a blow by compression gases when the compression chamber to the crank case.

A pair of cylindrical bosses 40 and 42 extend transversely within the interior of the piston. The bosses each define a generally cylindrical journal bearing surface 45 which receives the wrist pin at the top of the connecting rod which extends between the piston and the crankshaft. An axial space or gap 46 is provided between the inner ends of the bosses.

The interior surface of the piston head 26 is shown as being generally planar but may also consist of arcuate or domed sections which will help in dispersing lubricant downwardly within the interior of the piston. Because of the weight restrictions, the cylinder heads are generally manufactured having minimal wall thickness. Accordingly, in some engines, particularly high compression engines, it may be desirable to reinforce the piston head. As shown in FIGS. 3, 4, 5 and 6, this is accomplished by bridge member 50 which extends between the upper surfaces of the adjacent bosses 40 and 42. Bridge member 50 has a flat or planar upper surface 52 which abuts the inner surface of the cylinder head.

Figure 6:
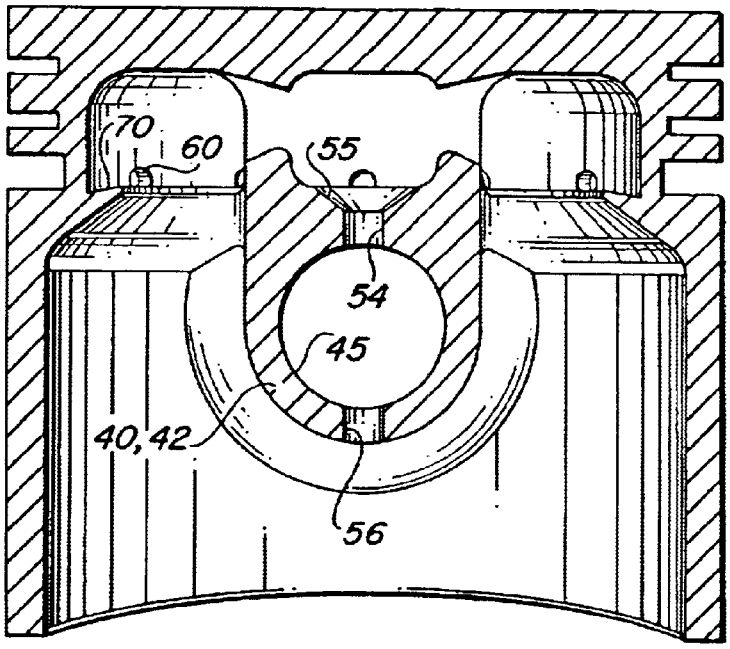
FIG. 6 is a cross-sectional view of a piston illustrating the lubrication passages for the wrist pin.

In order to enhance lubrication of the wrist pins, vertically extending bores 54 and 56 are provided through bosses 40, 42, as seen in FIG. 6. The upper surface of the upper bore 54 has a chamfer opening 55 which extends outwardly to collect oil within the interior of the piston and direct it on to the wrist pin and the bearing surface 45. Lower bore 56 allows oil to flow around the surface 45 and return to the oil reservoir in the crank case.

A particularly important aspect of the present invention is the provision of a trap which will pump oil during reciprocation of the piston. The upper oil ring 36 extends annularly about the outer wall of the piston located below the lower compression ring groove 34 and above the bosses 40 and 42. A plurality of circumferentially spaced holes 60 extend through the piston wall to the interior of the piston. An oil trap is located on the interior of the piston wall to collect and pump or disperse oil during operation. The oil trap consists of an annularly extending bottom surface 70 which surface extends upwardly with respect to the interior piston wall. The angle of the surface may be varied but preferably is between approximately 3°–60° with 50° having been found to work well. The surface 70 extends from a location immediately below the circumferentially arranged holes to an elevation corresponding approximately to the upper edge of the holes.

As seen in FIG. 1, a second or lower oil trap may be provided in the skirt portion of the piston below the wrist pin bosses spaced just upwardly from the lower edge of the skirt. The trap is also shown as comprising a plurality of annularly extending spaced-apart holes 82. An oil trap surface extends annularly around the interior of the piston and again includes an upwardly extending wall 84 which forms an acute angle with respect to the interior piston wall. The angular wall 84 extends from a location immediately below the holes 82 to an elevation at which upper ends of the wall approximately corresponds to the upper edge of the holes. Generally, a single oil trap is sufficient.

An oil ring 90 is received within the oil ring groove 36. If multiple oil ring grooves are provided, a ring is received in each. The oil ring is shown in detail in FIG. 7. The oil ring consists of an upper ring 92 which has generally flat opposite surfaces and may be split at 94 to accommodate expansion which occurs with heating. The upper ring 92 may scored or radially grooved at 95 to provide for release of trapped oil.

A lower ring 96 also has opposite flat surfaces provided with notches 98 on its outer periphery which are shown as being generally semi-circular. Interposed between the upper and lower oil ring is an expander ring 100 which is generally circular having a wave-like construction. The expander ring is formed from suitable material such as stainless steel. A plurality of holes 102 are spaced in the surface of the expander ring.

Figure 7:
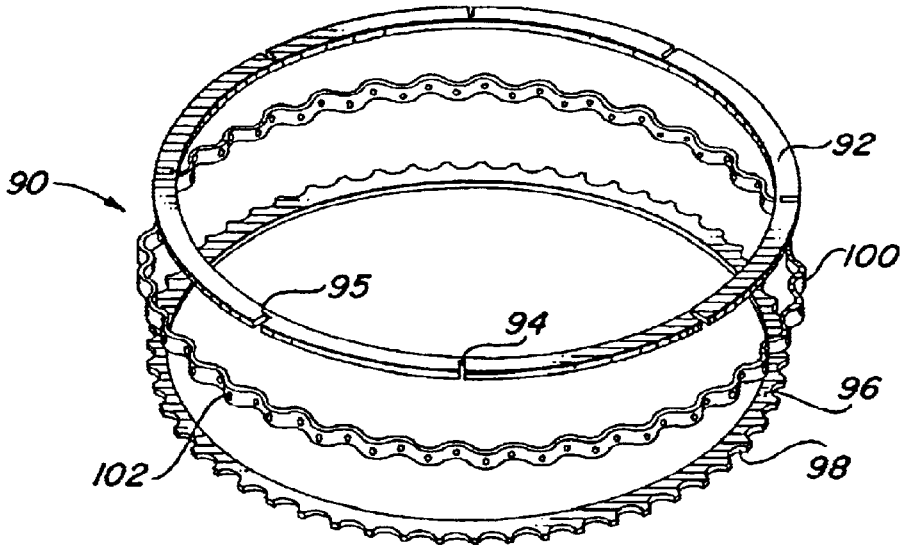
FIG. 7 is a perspective view of one form of the oil ring.
Figure 8:
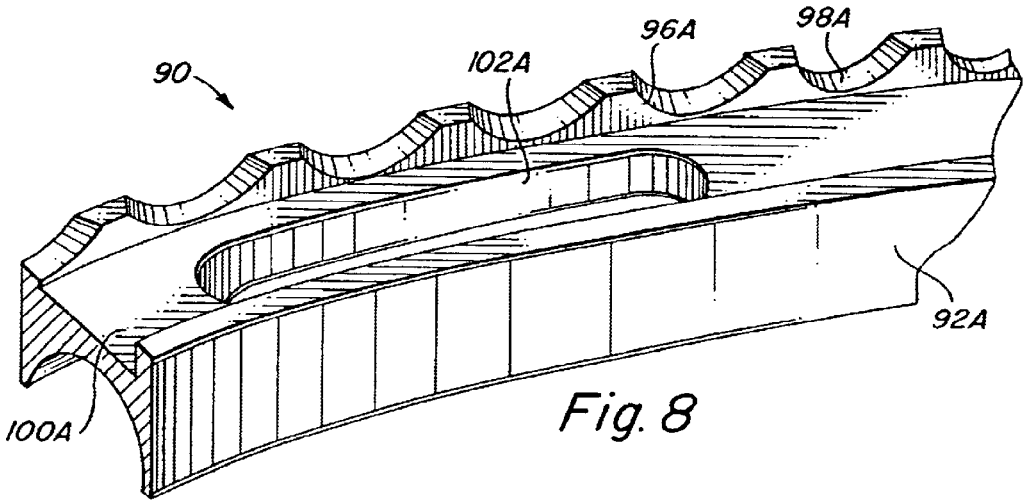
FIG. 8 is a perspective view showing an alternate form the oil ring in which the oil ring is integrally formed.

The oil ring 90 can be made as three separate components as shown in FIG. 7 or may be integrally formed as a single integral unit as shown in FIG. 8 in which the upper ring 92A, expander ring 100A and lower ring 96A are integral. Again, holes 102A are shown as elongate and are provided in expander ring 96A to allow oil to flow to and from the oil trap.

In operation, the upper ring 92 serves as a barrier to prevent the oil from reaching the combustion chamber. The intermediate expander ring 100 serves to spread or distribute oil evenly around the piston wall. The bottom ring 96 has a series of small notches 98 on the edge which allow the oil to move downwardly as the piston moves upwardly. This will serve to assist in keeping the oil cooler and will direct the cool oil moving between the rings downwardly to the crank case. The notches 98 are important as they will assist in dispersing the oil on the cylinder surface and the relieved area reduce friction between the piston and cylinder surface. The dispersion of the oil avoids formation of lacquer which occurs in conventional pistons due to burning of oil deposits on the walls.

In operation, the oil trap and pump sections defined by the internal lip or flanges 70 and 84 which extend around the interior surface of the piston are designed to capture oil on the downward stroke and deliver it to the holes associated with the flange or lip on the upward stroke. This movement will also have a cooling effect as the oil moving between the piston and cylinder wall will absorb heat and wipe residue off the cylinder wall and piston.

The upper holes 50 extend generally perpendicular to the cylinder wall and are located behind the upper oil ring 36. These holes are under pressure created by the oil trap and pump portion of the piston and will maintain pressure behind the upper oil ring. This will help keep the rings clean of carbon and burnt oil deposits.

The lower oil holes 82, as mentioned above, are angularly disposed with respect to the cylinder wall oriented between approximately 40° to 60° degrees. These holes serve to deliver oil between the cylinder wall and the piston under pressure from the lower oil trap and pump section of the piston. These holes will greatly help to maintain a supply of new oil to the cylinder and piston skirt under pressure. In addition, the lubrication is enhanced by the oil delivery holes communicating oil from the interior of the piston to the bearing surface interface of the wrist pins.

Figure 9:
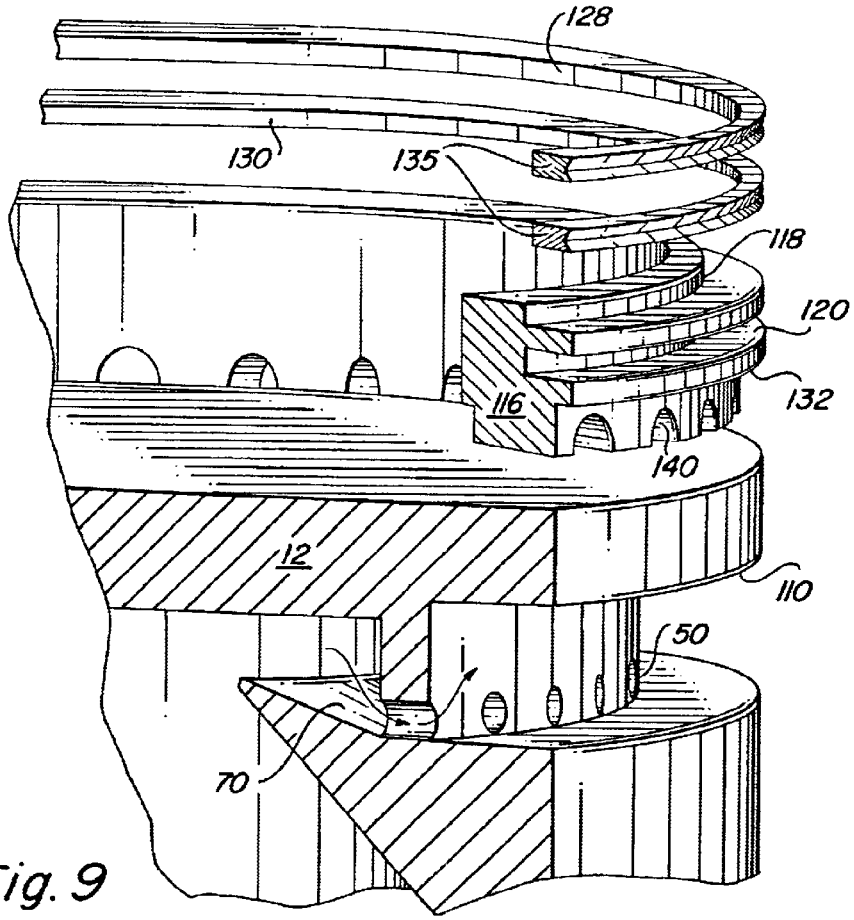
FIG. 9 illustrates an integral compression and oil ring assembly having the oil trap feature.

FIG. 9 is an exploded perspective view which illustrates another aspect of the invention in which the piston 12 is provided only with a single groove 110. The groove 110 is configured to receive a ring assembly 112 which is a combination ring operating as a compression ring and oil ring. Groove 110 communicates via holes 50 with oil trap defined by angular surface 70. The ring assembly 112 has a body 116 with two annular grooves 118, 120 which receive conventional compression rings 128, 130 which are conventional and which may be additionally provided with peripheral V-notches 135.

The lower portion of the body 116 is undercut at 132 and in the undercut area defines a plurality of notches 140 shown as being generally semi-circular. The notches are provided to permit free flow of oil through the notches between the cylinder/piston wall interface and the oil trap area, as described above. The upper surface of the undercut also assists in scraping the cylinder wall surface during piston reciprocation.

Thus the present invention provides a unique piston design adaptable for use with both combustion and diesel engines which trap oil and pump oil between the interior of the piston and the cylinder walls. Pumping action will greatly enhance lubrication, maintain a cooler well-lubricated engine and will also serve to scrape or remove debris from the cylinder walls.

It will be obvious to those skilled in the art to make various changes, alterations and modifications to the piston described herein. To the extent these various changes, alterations and modifications do not depart from the spirit and scope of the above description and appended claims, they are intended to be encompassed therein.

I claim:

1. A piston for an internal combustion engine of the type being reciprocal within a cylinder comprising:

(a) a generally cylindrical side wall having a head and defining an interior cavity having an interior wall;

(b) an annular compression ring groove in said side wall;

(c) an annular oil ring groove in said side wall;

(d) an oil trap disposed in said cavity opposite said oil ring groove having a bottom surface extending to capture oil;

(e) at least one aperture extending through said side wall at said oil ring groove whereby lubricant is captured as the piston reciprocates in one direction and is pumped through said aperture to said oil trap as the piston reciprocates in the opposite direction; and (f) said oil trap comprising an annular member having a bottom surface which extends from said interior wall of said cavity upwardly at an acute angle.

2. The piston of claim 1 wherein said oil ring groove includes an oil ring assembly having an upper ring, a lower ring and an intermediate section.

3. The piston of claim 2 wherein said intermediate section of said oil ring is an expander section and said lower ring has a plurality of peripheral notches.

4. The piston of claim 3 wherein said expander section has a wave-like configuration.

5. The piston of claim 4 wherein said oil ring assembly is an integral construction and said expander includes at least one aperture.

6. The piston of claim 1 wherein said interior cavity includes a pair of opposed bosses defining journal bearing surfaces.

7. The cavity of claim 6 further including a bridge connecting said bosses and supporting said piston head.

8. The bridge of claim 7 wherein at least one of said bosses define an oil receiving passageway communicating with said journal surface.

9. The piston of claim 1 wherein said compression ring groove and said oil ring groove are integrally formed in a single groove.

* * * * *